US007354330B2

(12) United States Patent
Bentley, Jr.

(10) Patent No.: US 7,354,330 B2
(45) Date of Patent: Apr. 8, 2008

(54) CONNECTION FOR BEADS WITH LOCKED AND ARTICULATING ENGAGEMENT

(75) Inventor: Charles W. Bentley, Jr., Woodstock, CT (US)

(73) Assignee: Lynx, Inc., Dayville, CT (US)

( * ) Notice: Subject to any disclaimer, the term of this patent is extended or adjusted under 35 U.S.C. 154(b) by 27 days.

(21) Appl. No.: 11/050,864

(22) Filed: Feb. 7, 2005

(65) Prior Publication Data

US 2005/0197039 A1 Sep. 8, 2005

Related U.S. Application Data

(60) Provisional application No. 60/541,914, filed on Feb. 6, 2004.

(51) Int. Cl.
*A63H 33/12* (2006.01)
*A63H 33/06* (2006.01)

(52) U.S. Cl. ..... 446/102; 446/120; 446/124; 63/39; 59/80

(58) Field of Classification Search ..... 446/102, 446/104, 120, 124, 126; 63/3, 4, 39; 59/80
See application file for complete search history.

(56) References Cited

U.S. PATENT DOCUMENTS

| | | | | |
|---|---|---|---|---|
| 2,714,269 | A | 8/1955 | Charles | |
| 2,752,726 | A | 7/1956 | Calverley | |
| 3,066,501 | A | 12/1962 | Charles | |
| 3,192,738 | A | 7/1965 | Charles | |
| 3,323,325 | A | 6/1967 | Meyer | |
| 3,357,204 | A | 12/1967 | Davis | |
| 3,822,499 | A | 7/1974 | De Vos | |
| 4,406,296 | A | 9/1983 | Wexler | |
| 5,769,681 | A | 6/1998 | Greenwood | |
| 5,928,051 | A | 7/1999 | Krog | |
| 6,023,946 | A * | 2/2000 | Magi | 63/9 |
| 6,109,999 | A | 8/2000 | Kuo | |
| 6,220,010 | B1 | 4/2001 | Gomez | |
| 6,264,522 | B1 | 7/2001 | Dickson | |
| 6,401,488 | B1 | 6/2002 | Cousin | |
| 6,491,563 | B1 * | 12/2002 | Bailey | 446/122 |

(Continued)

*Primary Examiner*—Kien Nguyen
(74) *Attorney, Agent, or Firm*—Andrew C. Aitken; Venable LLP

(57) ABSTRACT

An assembly of two elements including a first element that has a cavity with an external opening connected to a first region defined by a sidewall that is a spherical segment and the diameter of the external opening is smaller than the diameter of the sidewall in the first region. Adjacent to the first region is a second region also defined by a second spheroid segment that is separated from the first region by an annular ring extending from the sidewalls towards a central axis of the cavity. The annular ring forms a passage having a diameter approximately the same as the external opening. An extension member on the second element is inserted into the cavity which has a first rod section terminating in a second spherically-shaped section. The spherically shaped section has a diameter larger slightly larger than the external opening on the first element and accordingly, the spherical section may be snap-fitted through the external opening to a first position in a first region, and be retainer there and, it may be further snap-fitted through the passage to the second region and be retained there. Also disclosed is flange structure that engages an annular seat when the spherically shaped member is in the second position.

17 Claims, 6 Drawing Sheets

RIGID & NON-ROTATING LOCKING POSITIONS

U.S. PATENT DOCUMENTS 6,572,429 B2 * 6/2003 Cheung ..... 446/120
6,694,721 B2 2/2004 Gomez
6,698,238 B1 * 3/2004 Cheng ..... 63/23

* cited by examiner

CONNECTOR

RIGID-SECOND LOCKING POSITION

CONNECTION FOR BEADS WITH LOCKED AND ARTICULATING ENGAGEMENT

CROSS REFERENCE TO RELATED APPLICATION

This application claims the benefit of U.S. Provisional Application No. 60/541,914, filed Feb. 6, 2004, entitled Connection for Beads with Locked and Articulating Engagement.

BACKGROUND OF THE INVENTION

For many years metal and plastic interlocking pieces have been manufactured and sold as toys and model building materials for children, teenagers, and young adults. For example, LEGO building blocks remain popular today. Other types of interlocking pieces have also appeared at various times in the form of interlocking beads for inexpensive decorative items such as bracelets, necklaces, and also as basic materials for craft and novelty items, drapery and window blind adjustment controls, and similar household items. Interlocking thermoplastic resin members have also been developed as industrial materials for adjustable tubing for coolant sprays in machining operations, as flexible drive shafts for slow speed and low power applications, and as adjustable length drive chains for non-slip low energy applications.

While many variations and applications exist, the examples noted above are thought to represent a broad cross section of the prior art related to interlocking components for decorative, craft, entertainment, and functional applications. Specifically, some of those products identified above are manufactured from molded resin. Many of these items have been specially designed and engineered for their targeted applications, and as a result, the opportunity for use on a broader scale may not be optimized due to engineering and other practical considerations.

SUMMARY OF THE INVENTION

The present invention is directed to a system for interlocking a plurality of parts such as beads. In a preferred embodiment each part includes at least one extension structure that is adapted to be received into an opposite cavity on an adjacent part to form an interlocking relationship. The relationship between the extension structure and the opposite cavity allows for variable engagement arrangements including a first arrangement that permits articulating movement and an alternative locking engagement that maintains the resulting assembly in a linear relationship. Parts may be assembled into catenulate chains or, by providing for additional connection structures originating from other surfaces of the part, the parts may be assembled into networks or matrixes that extend in multiple directions. In addition to the articulating chain arrangement and locked engagement arrangement, a further engagement is disclosed that prevents rotational movement from one part to another.

DETAILED DESCRIPTION OF THE INVENTION

The present invention is directed to an article of manufacture that is specifically addressed, but is not limited to, the novelty, craft, and recreational arts. The invention provides a novel and significantly improved design over prior art devices by allowing interlocking of adjacent members in three dimensions, with each attachment selectable at the time of assembly as either a rigid or articulating connection.

In the simplest form, the invention comprises a molded bead configured to include a connector in the form of an extended arm that terminates in a ball having a much reduced diameter. The bead may also contain a hole or cavity, preferably on a side opposite the connector, wherein the hole or cavity is shaped as a socket to receive and lock the ball that extends from the molded bead. While in a preferred embodiment the bead is a sphere having a diameter approximately ⅜ to 1 inch, other sizes and shapes are feasible and contemplated and disclosed herein.

Figure 1:
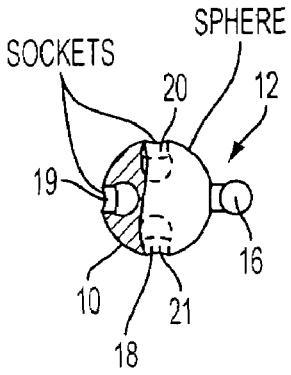
FIG. 1 is a side view in elevation, partially cut away, and partially in phantom, of an interlocking part according to a first embodiment of the invention.
Figure 2:
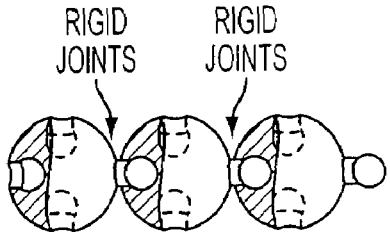
FIG. 2 is a side view of the embodiment depicted in FIG. 1 shown in engagement with a plurality of adjacent parts.
Figure 3:
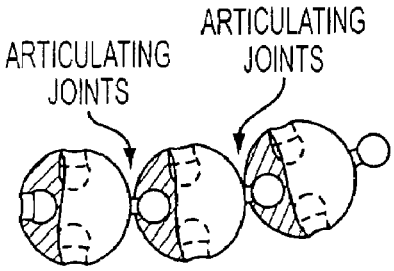
FIG. 3 is a side view of the embodiment depicted in FIG. 1 that enables the joints to articulate with respect to one another.
Figure 4A:
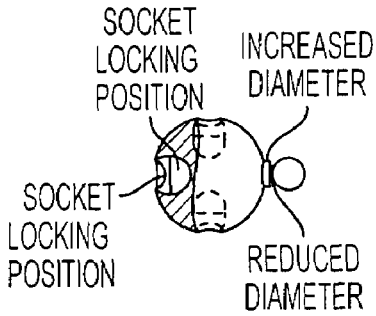
FIG. 4*a* depicts a second embodiment of the invention wherein a connector arm has an increased diameter dimension adjacent to the part and a reduced diameter adjacent to the spherical engagement element of the connector arm.
Figure 4B:
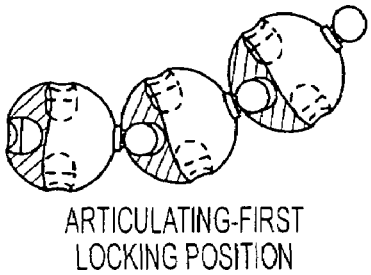
FIG. 4*b* shows the embodiment depicted in FIG. 4*a* in an articulating arrangement.
Figure 4C:
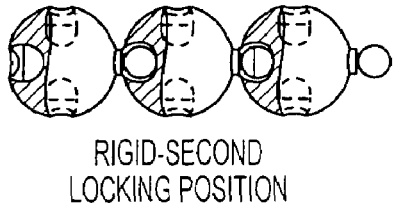
FIG. 4*c* depicts the embodiment depicted in FIG. 4*b* in a locked arrangement.
Figure 14:
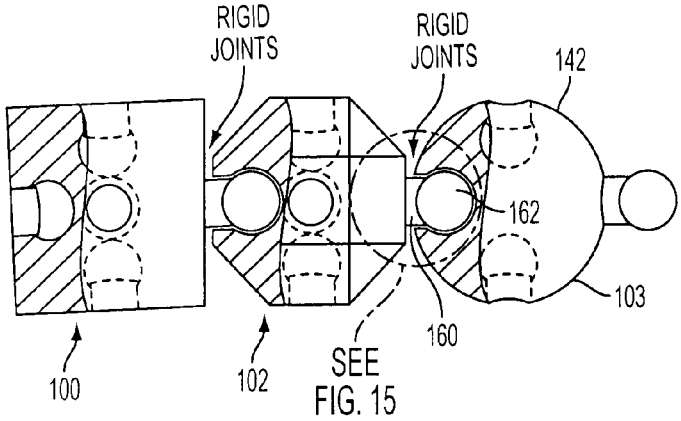
FIG. 14 depicts a further embodiment in elevation and partial section where adjacent parts are connected together in a linear arrangement.
Figure 15:
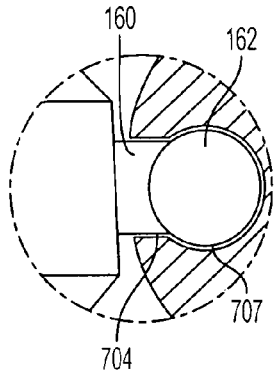
FIG. 15 is an enlarged view of the joint depicted in FIG. 14
Figure 16:
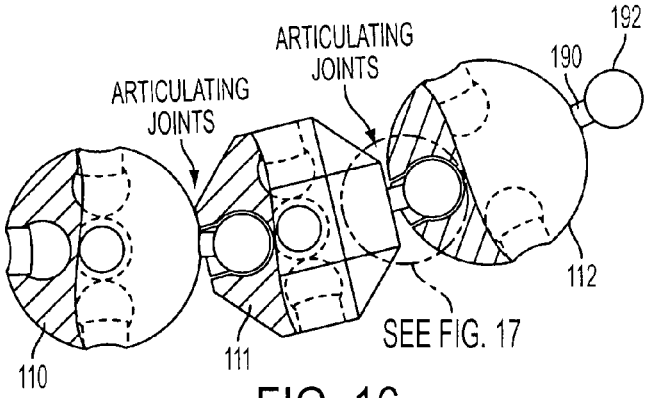
FIG. 16 depicts a further embodiment in elevation wherein the joint is permitted limited articulation.

Referring now to FIG. 1, a first embodiment is depicted that includes a bead 10 on which is provided an extension 12. The extension includes a leg 4 and a spherically shaped head 16. Also provided on bead 10 are a plurality of cavities 18, 19 and 20 that are formed to receive a complementary connector. In a first embodiment of the invention the cavity is formed with a circular opening 21 having a diameter that is slightly smaller than the maximum diameter of the head 16. Head 16 may be inserted into the smaller circular opening because the materials that the part is made of are elastic and resilient and therefore may be slightly compressed and deformed to allow the larger sphere to fit within the smaller opening. As best seen in FIG. 15 and FIG. 18, in one embodiment of the invention the cavity has a first cylindrical region 204 that has a maximum dimension that is slightly smaller than the spherical ball extension. A second socket region 707 receives the ball 162 and allows for very limited motion within the socket. Motion of the ball is restricted in view of the relationship between the stem 160 within cylinder 704. There are at least two connector arm arrangements that can be integrated with parts depicted in FIG. 15, FIG. 17 and FIG. 20. As best seen in FIG. 15, a connector arm in this first embodiment has a stem 160 that has a maximum diameter that is slightly smaller than the diameter of the cylinder section 704. In this arrangement, the parts when assembled will generally stay aligned in a linear arrangement such as that depicted in FIG. 14. FIG. 14 also depicts the use of parts that have different shapes. In the embodiment depicted in FIG. 14 the parts 100, 102 and 103 are able to rotate with respect to one another about the linear axis formed by the sequential parts.

Figure 17:
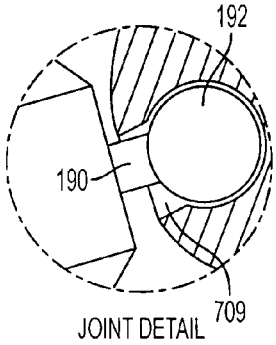
FIG. 17 depicts an enlarged view of the joint identified in FIG. 16.
Figure 18:
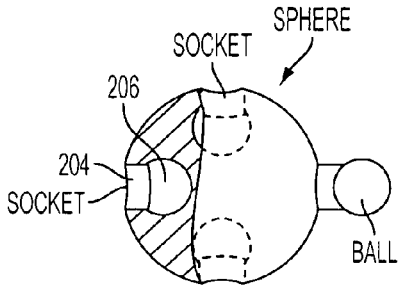
FIG. 18 depicts part 142 of FIG. 14 in elevation and partial section.

FIG. 17 depicts an arrangement wherein the connector stem 190 has a reduced diameter in comparison with connector stem 160 shown in FIG. 15. In this arrangement the sphere 192 is the same size as sphere 162 and the connector will fit within the same size cavity. However because the dimension of the stem does not closely conform to the dimension of the cylinder 709, the parts have some limited movement with respect to one another.

Figure 19:
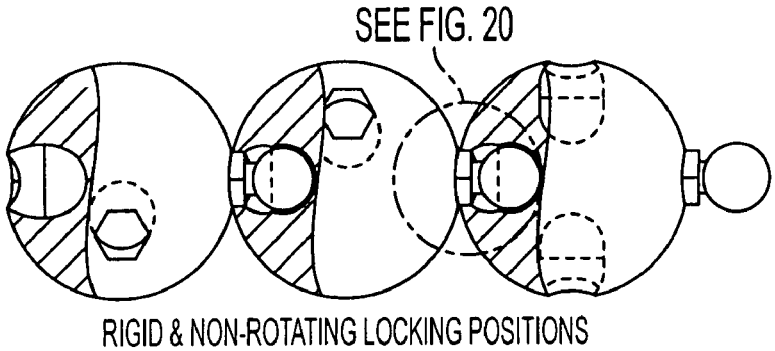
FIG. 19 depicts yet another embodiment wherein the opening of the cavity of the part and the collar of the connector of the part are not round.
Figure 20:
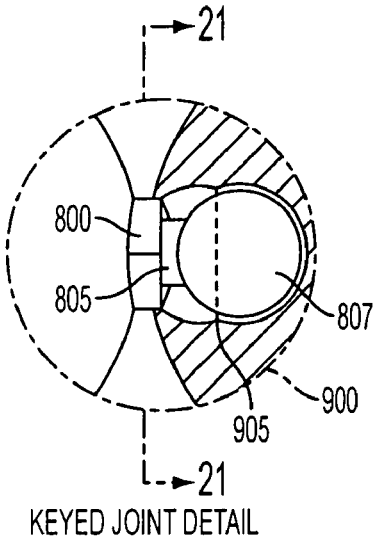
FIG. 20 depicts a joint between two parts depicted in FIG. 19
Figure 21:
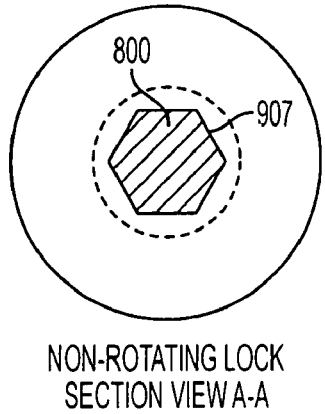
FIG. 21 depicts a sectional view of the collar of the connector on a first part in engagement with a second part.
Figure 22:
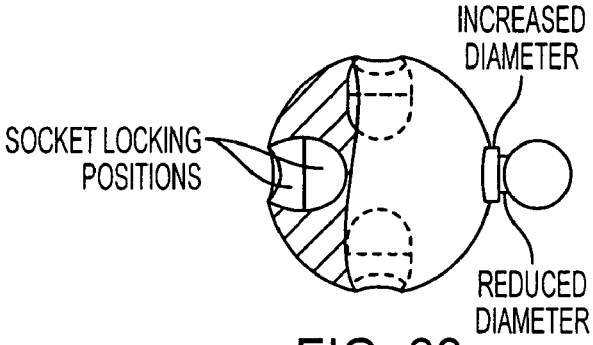
FIG. 22 depicts an enlarged view of the part depicted in FIG. 4*a* that includes a collar on the connector.

Now referring to FIG. 19 a further embodiment of the invention is disclosed. This embodiment allows for two engagement arrangements, a first wherein the parts are in engagement that allows articulation like that depicted in FIGS. 12 and 13, and a second rigid and locked arrangement. As best seen in FIG. 20, the second arrangement differs from the arrangement depicted in FIGS. 11 and 12 because the collar 800 does not have a round axial profile. By employing a collar that is not round, and a complementary recess on a cavity of the adjacent part, the parts can be prevented from rotating with respect to one another. As best seen in FIG. 21, the collar has a hexagonal shaped axial profile that fits into a hexagonal shaped recess 907 formed around the opening of the cavity 905 in part 900. Other shapes are contemplated, including but not limited to triangular profiles, square profiles, octagonal profiles etc. Further, although they show collar section 800, a stem 805 and a ball 807, it is contemplated that the stem may be unnecessary and the ball section 807 could be provided directly on collar 800.

Figure 10:
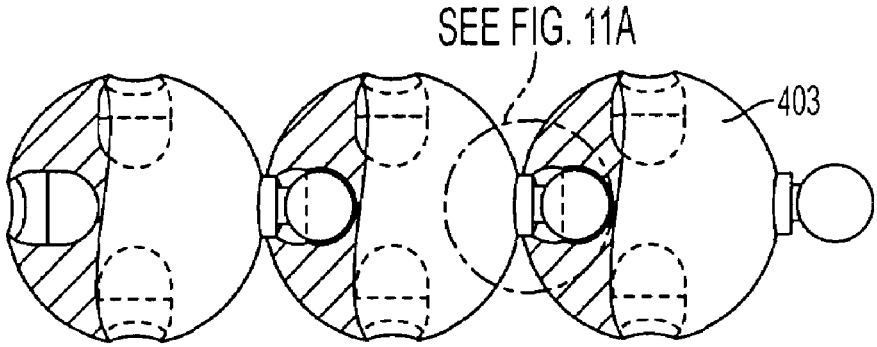
FIG. 10 is a view in elevation of a series of parts engaged to one another in a rigid linear arrangement made in accordance with the invention that is partially cut away.
Figure 11A:
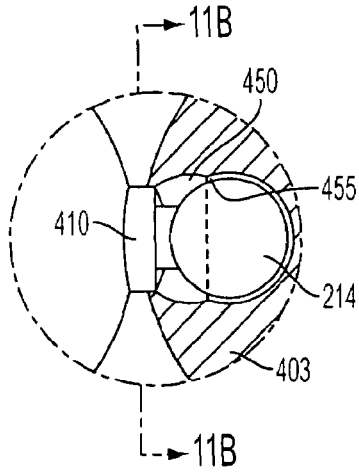
FIGS. 11 and 11*b* are enlarged views of a joint section of FIG. 10.
Figure 11B:
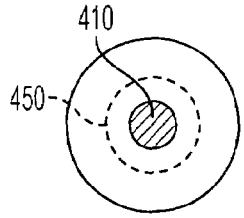
Figure 12:
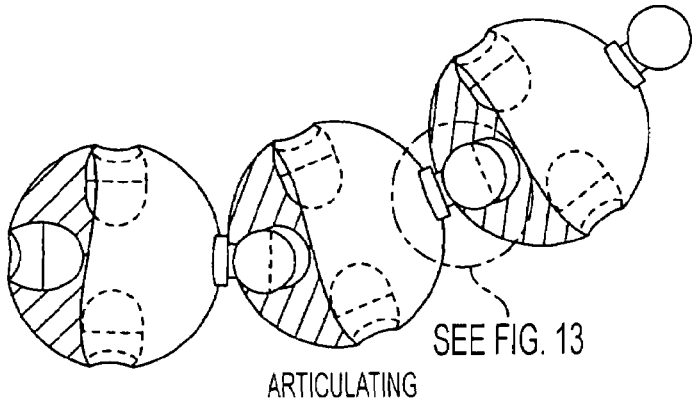
FIG. 12 is a view in elevation of a series of parts engaged to one another in an articulated rigid arrangement made in accordance with the invention that is partially cut away.
Figure 13:
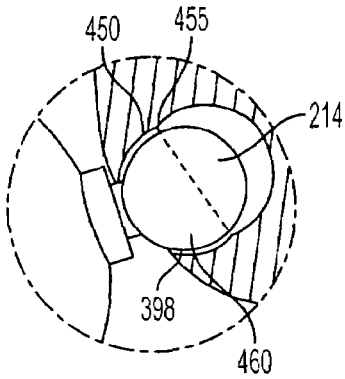
FIG. 13 is an enlarged view of the joint depicted in FIG. 12.

Now referring to FIG. 10, this embodiment is directed to a relationship between the connector and cavity wherein the cavity may receive the ball of the connection in two different locked positions. FIG. 10 depicts the connector in a first locked position wherein the parts are in a linear relationship with one another. As best seen in FIG. 11, a collar 410 is received in opening 403. As seen in FIG. 11*b*, in this embodiment, collar 410 has an annular shape and it is received in an opposite circular opening 403 recess of the cavity. Because the shape of the collar is round, the parts may rotate with respect to one another when they are in engagement. From the opening 403 the dimension of the cavity increases to a location 450 where the diameter of the cavity has a maximum dimension then decreases to a ridge 455. As best seen in FIG. 13, ball 460 can be locked into a first region in the cavity generally defined by the opening 398 and ridge 455. In this first region adjacent parts can articulate with respect to one another as depicted in FIG. 12. FIG. 11 depicts the ball section of the connection arm in the second posterior section of the cavity. In this second arrangement, the collar is engaged in the opening and the ball 214 has been forced past annular ridge 455. Ridge 455 extends around the interior surface of the cavity. While in the preferred embodiment the ridge is a continuous ridge, it is possible to have an intermittent ridge wherein there are spaces that are interrupted. Also, as depicted in FIGS. 11 and 13, the second region extending to the bottom of the cavity appears to have the same axial dimension until the bottom where the cavity ends in a spherical shaped cavity, it is contemplated that the dimension of the cavity could increase to a maximum dimension and then decrease. In yet a further contemplated embodiment the ridge can be further built up to define a discrete annular bulge or hump separating the first region from the second region. This alternative ridge structure could be built up along the interior surface of the cavity. To the extent that the ridge extends from the surface of the cavity, it can serve to either retain the ball 214 within the second region, or keep the ball from entering the second region absent sufficient force to compress the 455 ridge and ball 214 so as to snap-fit the ball into the second region. In other words in order to pass through the opening 398 and pass by the annular ridge 455, the opening or ridge on the cavity and ball 214 are slightly compressed. When the ball section passes the opening 398 or ridge 455, because the resin is slightly elastic and resilient, the ball can be locked into either the first or second region. When the ball is in the second region, the ridge 455 maintains the ball in place unless sufficient force is imposed upon the part to once again deform the respective components so that the ball can be removed.

By providing a number of interchangeable design variations in the cavity and connector configurations the assembler may select either a rigid or an articulating coupling depending on the selection of components and/or the depth of insertion. Further, when the parts are in the locked linear relationship, they can be either rotated or be in a fixed position.

A further configuration that comprises a connector arm segment having a significantly reduced diameter between the main sphere and the ball, allows for articulation.

Interchanging of parts of the various configurations allows the type of joint to be selected with the assurance that designated rigid joints will remain rigid, designated articulating joints will remain flexible, and variable joints can be locked and unlocked as desired.

Figure 5A:
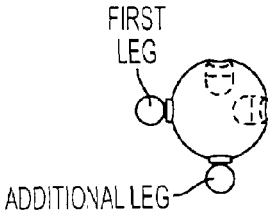
FIG. 5 is a view in elevation and in partial phantom that depicts various alternative embodiments showing different combinations of connector arms and cavities.
Figure 5B:
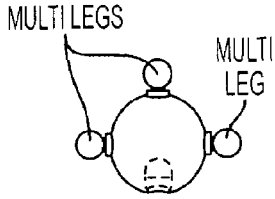
Figure 5C:
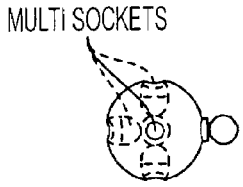
Figure 6:
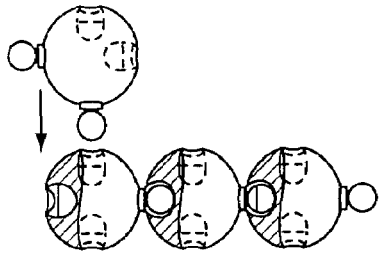
FIG. 6 depicts an arrangement wherein a part is in position to engage a catenulate chain of parts from a lateral position.

An enhancement over the basic design described above incorporates additional cavities and leg at ninety degrees to the first hole and leg respectively, as well as pieces with one connector and multiple holes. See FIGS. 5 and 6. Parts with these enhanced features allow two and three dimension construction to be accomplished when combined with the basic components, wherein the basic pieces form the starting and ending row, and the enhanced pieces are used to construct the planar areas and third dimension structures between the starting and ending rows as shown in FIG. 6. From this it can be seen that a limitless number of designs can be constructed by mixing basic and enhanced pieces.

Figure 7A:
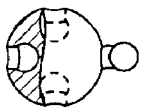
FIGS. 7A-7C depict various size parts that may be formed that have complementary connector arm extensions and cavities.
Figure 7B:
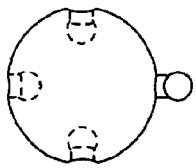
Figure 7C:
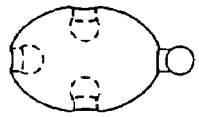

Referring now to FIG. 7, it should be appreciated that the size and shape of the main body can vary. Spherical pieces of larger diameters that are multiples of the basic size, and that incorporate the standard arm and socket configuration will facilitate the assembly of a wider range of designs and shapes. Additionally, parts formed in an elliptical shape wherein the body diameter is that of the basic sphere and the length is a multiple of that diameter, will be of similar interest.

Additional accessory items such as rails of various lengths having arms and sockets or base members such as planer shaped plates having arms and/or sockets incorporated thereon may also be provided. For example a rail member having an axial dimension approximately the same as the sphere diameter is provided with sockets or cavities oriented in various patterns that allow for a variety of engagements. It can be readily appreciated that yet additional shapes and configurations may be created. FIG. 14 depicts parts that include a cube and a complex polygon. Flat parts with sockets and/or connector projections oriented along the edges and other surface patterns will also enhance the range of project shapes. By providing sockets (or cavities) or projections on accessory items, additional items may be engaged.

OTHER APPLICATIONS

While primarily intended for use in toy and craft applications, other important uses of the invention can easily be imagined.

Industrial Mats and Filters

The ready formation of the spheres into virtually any shape allows work surface mats to be made to custom fit workstations. The irregular surface is an advantage over standard work mat materials by providing recesses for metal or plastic chips, short wire strands, and other types of scrap or dirt to drop into to thereby lessen the chances of workplace contamination. The materials may be formed together in a matrix that is either rigid or flexible. The beads can be almost any shape and thereby a matrix that is formed can have different characteristics. For example, square beads or cylindrical shaped beads can be designed in planar arrangements that have flat opposite surfaces. The beads can be assembled in a single endless chain and be used as a drive mechanism.

A related recreational/commercial application is as a surface for cleaning fish or for bait preparation. The closely spaced spheres provide a good support surface when placed in a sink or on other surfaces commonly used for these applications, while the spaces between the spheres allow rinse water and other liquids to drain easily. By selecting small beads in a closely spaced arrangement a matrix may be formed that can trap materials such as metal or plastic chips from cutting lubricants and hydraulic oils.

Figure 8:
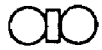
FIG. 8 depicts a connector part in elevation that may be used to connect two parts having cavities.
Figure 9:
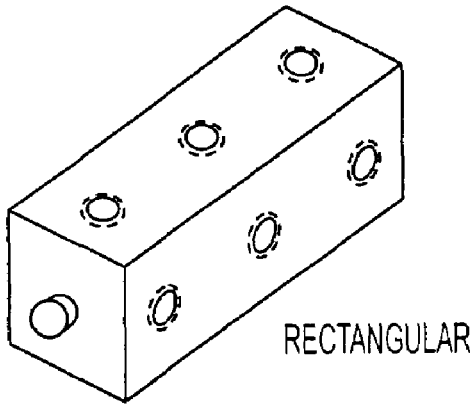
FIG. 9 depicts a part in elevation that is a polygon and has a series of cavities on the lateral sides and a connector extension on one end.

It is further contemplated that the additional accessory items can be attached into the cavities to integrate additional structures with the connector parts such as that depicted in FIG. 8. For example, in a filtration application, fibrous or brush like extensions could be integrated with a connector part. Other contemplated structures may include elongate spikes or suction cups.

The invention having been described in detail with respect to preferred embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. An assembly comprising a first element and a second element, said first element and said second element comprised of a compressible and resilient material, a cavity within said first element, said cavity having a first region defined by a sidewall formed by a spherical segment, said first region having an external opening through the surface of said first element, wherein the diameter of said opening is smaller than the diameter of said sidewall, and a second region defined by a second spheroid segment, and second spherical segment region contiguous with said first region and said second region located further from said opening than said first region and said second region separated from said first regions by an annular ridge having a diameter, and an extension connector member on said second element, said extension connector member extending from said second element and comprising a first rod section terminating in a second spherical shaped section, wherein said spherical shaped section has a diameter larger slightly larger than said external opening on said first element, and slightly larger than said diameter of said annular ridge to said second region, wherein said spherical section may be snap-fit through said external opening to a first position in said first region, and be retainer therein and, be further snap-fit through said annular ridge to said second region and be retained therein.

2. The assembly recited in claim 1 wherein said compressible and resilient material comprises synthetic resin.

3. The assembly recited in claim 2 wherein said synthetic resin comprises polyethylene.

4. The assembly recited in claims 1 wherein said first and said second elements are solid.

5. The assembly recited in claim 1 wherein said elements comprise spherically-shaped beads.

6. The assembly recited in claim 1 wherein said rod section is self-supporting.

7. The assembly recited in claim 1 wherein said external opening on said first element is further defined by an round seat region around said opening, said round seat region defining an annular ledge around said opening, and said assembly further comprising a round flange element on said second element around the base of said rod at the location it extends from said element, wherein said round flange element may be fitted in said round seat region and seated on said ledge when said spherical section is positioned in said second region, whereby said round flange element may be rotated within said round seat region, and said external opening is provided in the center of the polygon shaped cavity.

8. The assembly recited in claim 1 wherein said external opening on said first element is further defined by a polygon shaped cavity proved on the surface of said element and surrounding said opening and said wherein said second element comprises a extension connector member with a flange having a polygon shaped collar at its base complementary to said polygon shaped cavity that may be received in said cavity, and when said flange is seated in said polygonal cavity, the first and second elements may not be rotated with respect to one another, and said external opening is provided in the center of the polygon shaped cavity.

9. The assembly recited in claim 1 wherein each said element has at least one extension member and a plurality of cavities.

10. An assembly comprising a first and a second element, wherein at least one of said elements comprises a material that is resilient, said first element comprises a cavity, said cavity further comprising a first retention region, said first retention region defined by a first restricted area having a constricted opening and a second constricted region, wherein said first and second constricted regions have a minimum circumference less than that a maximum circumference of a sidewall of said first region, and a second region, said second region defined by said second constricted region and, and wherein said second element comprises an extension member, said extension member extending from said second element and comprising a first rod section terminating in a second section, said second section having an dimension slightly larger than said constricted regions, and smaller than the dimension of said first and second regions wherein said second section of said extension member may be snap-fit through said first constricted region to be seated at a first position in said first region and be retained therein and, be further snap-fit through said second restricted region to be seated in said second position and be retained therein.

11. The assembly recited in claim 10 further comprising an annular collar around said opening to said first region, said annular collar defining an annular ledge around an opening into said first region, and said assembly further comprising a flange element on said second element around the base of said first rod section of said extension member at the location said rod extends from said element, wherein said flange element may be seated on said annular ledge when said enlarged section of said extension member is in said second position in an arrangement that allows for rotation of the first element with respect to said second element.

12. The assembly recited in claim 10 wherein an axial section through said annular ledge is a polygon and said flange is a polygon, and when said flange is seated in said annular ledge, the first and second elements may not be rotated with respect to one another.

13. The assembly recited in claim 10 wherein said constricted regions on said cylinder are defined by a continuous annular ridge formed around said cylindrical sidewall.

14. The assembly recited in claim 10 wherein said constricted regions is defined by a plurality of extensions, said extensions extend radially from said sidewall of said region towards a central axis of said region.

15. The assembly recited in claim 10 wherein said rod region is comprised of a flexible material and is not self-supporting.

16. The assembly recited in claim 10 further comprising a polygon shaped cavity on the surface of the first element and surrounding said opening to said first region, said polygon shaped region defining a recessed seat around said opening into said first region and said assembly further comprising a flange element on said second element around the base of said first rod section of said extension member at the location said rod extends from said element, wherein said flange element has a complementary shape that can be positioned in said recessed seat when the spherical shaped region of said extended rod is in said second position, wherein said arrangement prevents the rotation of said first and second element with respect to one another.

17. The assembly as recited in claim 10 wherein said first and said second regions are generally defined by spherically shaped walls.

* * * * *